US005237863A

United States Patent [19]

Dunham

[11] Patent Number: 5,237,863

[45] Date of Patent: Aug. 24, 1993

[54] METHOD FOR DETECTING PUMP-OFF OF A ROD PUMPED WELL

[75] Inventor: Cleon L. Dunham, Houston, Tex.

[73] Assignee: Shell Oil Company, Houston, Tex.

[21] Appl. No.: 802,799

[22] Filed: Dec. 6, 1991

[51] Int. Cl.[5] ..... E21B 47/00; F04B 49/00

[52] U.S. Cl. ..... 73/151; 166/250; 417/63; 417/53

[58] Field of Search ..... 73/151; 166/250; 417/63, 53, 12, 18; 364/422

[56] References Cited

U.S. PATENT DOCUMENTS 4,487,061 12/1984 McTamaney et al. ..... 73/151
4,541,274 9/1985 Purcupile ..... 73/151
4,583,915 4/1986 Montgomery et al. ..... 73/151
5,064,349 11/1991 Turner et al. ..... 417/53

*Primary Examiner*—Hezron E. Williams
*Assistant Examiner*—Michael Brock

[57] ABSTRACT

A method for monitoring a rod pumped well and detecting when the well is pumped off. The method utilizes the measured rod load and position for each stroke to set load limits and position limits. The load limits and position limits are set as predetermined percentages of the difference between the maximum and minimum measured rod load and position. The area within the thus determined load and position limits is determined to detect when the well has pumped-off.

8 Claims, 3 Drawing Sheets

FIG. 1
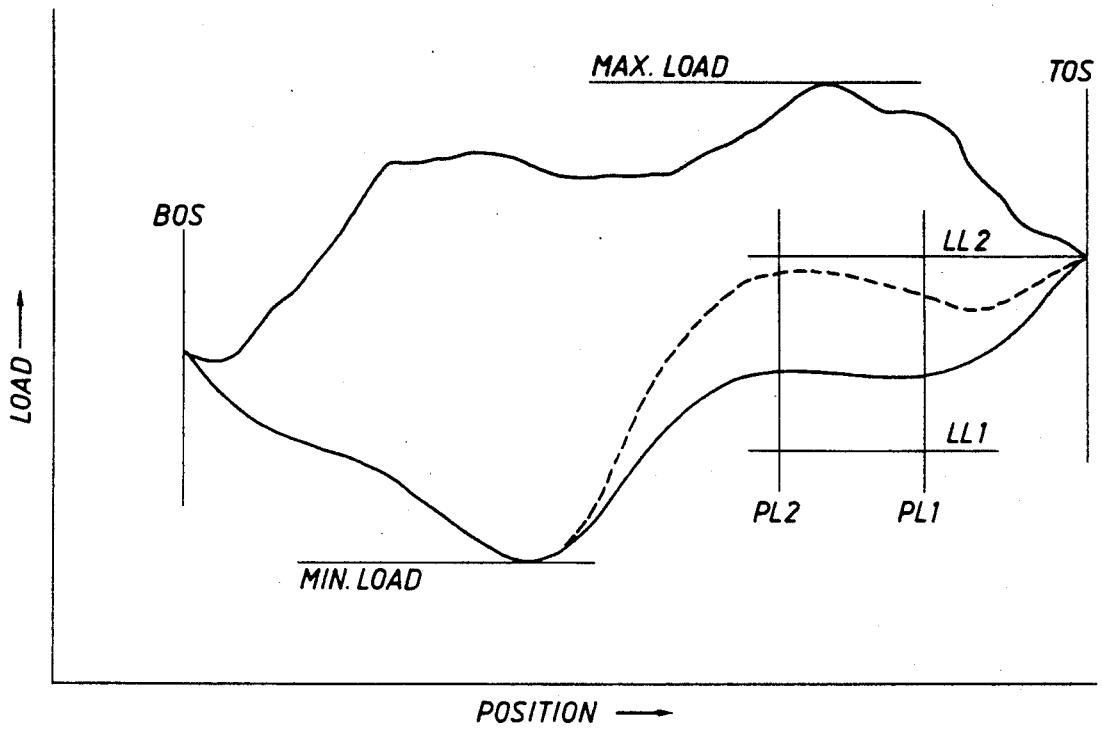
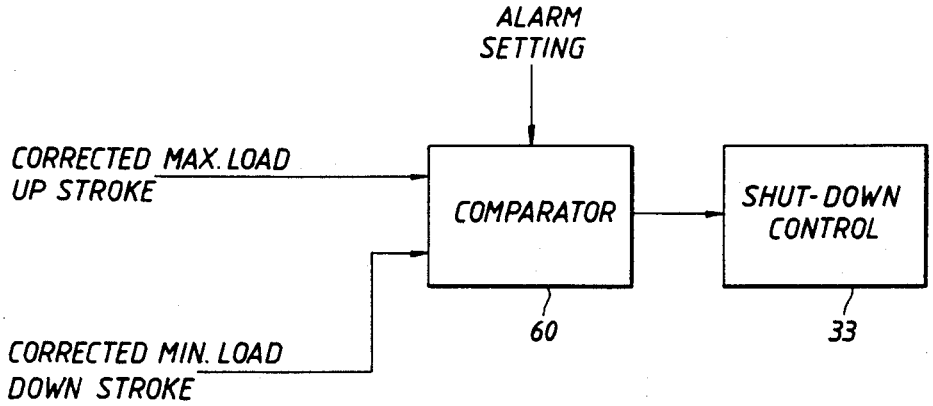
FIG. 4

METHOD FOR DETECTING PUMP-OFF OF A ROD PUMPED WELL

BACKGROUND OF THE INVENTION

The present invention relates to pump-off controllers for beam pumping systems used in producing oil wells. The term 'beam pumping systems' refers to pumping units of the type having a walking beam for reciprocating a rod string that extends down the well to operate a pump unit located at the bottom of the well. The downhole pump has a travelling valve in the plunger and standing valve at the bottom of the pump barrel. The travelling valve opens on the downstroke when the plunger contacts fluid in the barrel and closes on the upstroke while the standing valve remains closed on the downstroke and opens on the upstroke to allow fluid to enter the barrel.

Pump-off controllers are used to shut down beam pumping systems when the well has pumped off, the controller re-starts the beam pumping system after a preset down time. The term "pumped-off" is used to describe the condition where the downhole pump does not completely fill with fluid on the upstroke of the pump. On the succeeding downstroke the rod string and plunger of the pump fall until the plunger contacts the fluid in the pump barrel. When the piston contacts the fluid, a vibration or shock wave is transmitted through the rod string to the beam pumping unit. This can cause damage and failure of the rod string or pumping unit. In addition, when the pump is not completely filled with fluid, the pump is not lifting as much fluid as when the pump is full. This can result in increased energy costs for the quantity of fluid produced.

U.S. Pat. No. 3,951,209 describes a pump-off detection method in which the load on the rod string and the position of the rod string are measured. From the load versus displacement measurements the energy input to the top of the rod can be calculated by integrating the product of load times displacement. When the well has pumped off, the energy input to the rod will be reduced since the load on the rod at the start of the downstroke remains high. The reduction in energy input to the rod string can be used as a control signal for controlling the operation of the pump unit.

U.S. Pat. No. 4,015,469 describes an improvement of the method described in the above patent wherein the energy input to the rod is calculated for only a portion of the pump stroke. As described in this patent, the greatest change in the energy input to the rod occurs during the first part of the downstroke of the pump. The greater change in the energy input produces a more reliable detection of when the well has pumped off.

U.S. Pat. No. 4,583,915 describes a method for detecting pump-off which calculates an area bounded by two positions of the rod string and the minimum rod load and the actual load. While this is not a true calculation of the energy input to the rod, it can be related to the area calculated in U.S. Pat. No. 4,015,469. The area that is measured in the U.S. Pat. No. 4,583,915 patent is outside the dynagraph or pump card while only the area inside the card represents the energy input to the rod.

A pump-off controller sold by Baker-CAC of Houston, Tex. and referred to a Baker Model 8500 utilizes percentages of the measured load and displacement to set limits for determining pump-off. This pump-off controller detects pump-off by tracking where the measured load crosses the set load line. When the crossing point moves to the left of the position line the well is pumped off. This controller does not monitor the energy input to the rod string as described in the above referenced patents.

The methods described in the above patents for determining pump-off are satisfactory in many applications but fail in some other applications. In the case of a high fluid level caused by the long shutdown of the pumping unit, the calculation of an area gives a false pump-off signal and prematurely shuts the pumping unit down. This, of course, reduces the total production from the well. Similar problems occur when gas is present in the well fluid.

In addition to the above problems, the prior systems, while including means for correcting the various devices used to measure load and position for various errors, did not provide an accurate result. For example, errors introduced by temperature changes or errors that result from incorrect data relating to fixed pump parameters. Likewise, errors can result from a failure to properly calibrate the measuring devices used to measure the load on the rod string and the position of the rod string.

SUMMARY OF THE INVENTION

The present invention overcomes the above problems by measuring the minimum and maximum load on the rod string and the maximum and minimum stroke positions. The measured analog values are converted to digital numbers and used in determining pump-off. Instead of converting the digital numbers to actual engineering units as is done in the prior art, the present invention utilizes percentage of the digital numbers for all calculations. Thus, the area is expressed as a percent-squared instead of pounds-feet as in the prior art. By using percentages rather than actual engineering units, the present invention solves the problem of a reduced area of the pump card that occurs when a well is restarted after a prolonged shutdown period. As described in the prior art, the shutdown of a well for a prolonged period usually produces a high fluid level in the well. The high fluid level in a well results in less energy being required to lift the fluid to the surface and thus the area within the pump card is reduced upon start-up. In prior art devices it was necessary to put time delays in the controller to allow the well to stabilize before attempting to calculate pump-off or utilize other means for handling high fluid levels in a well. Since the present invention utilizes only percentage measurements the reduction in the area of the pump card is compensated for automatically.

The invention also includes means for correcting the stroke measurement for errors that occur when the closure of a switch is used for determining the rod position instead of a continuous position measuring transducer. Likewise, the invention includes means for correcting a beam mounted load cell for both the angle of the walking beam as well as the temperature offset.

In addition, the invention incorporates means for alarm and shutdown logic for detecting the occurrence of various problems in the pumping unit, such as malfunction of the pump valves, rod parts or a stuck pump.

BRIEF DESCRIPTION OF THE DRAWINGS

FIG. 1 is a drawing of a pump card showing the various measurements that are utilized in the present invention as well as a full pump card and a pumped-off pump card.

FIG. 4 is a block diagram of the logic used for detecting various malfunctions of the pumping unit.

DESCRIPTION OF THE PREFERRED EMBODIMENT

Figure 2:
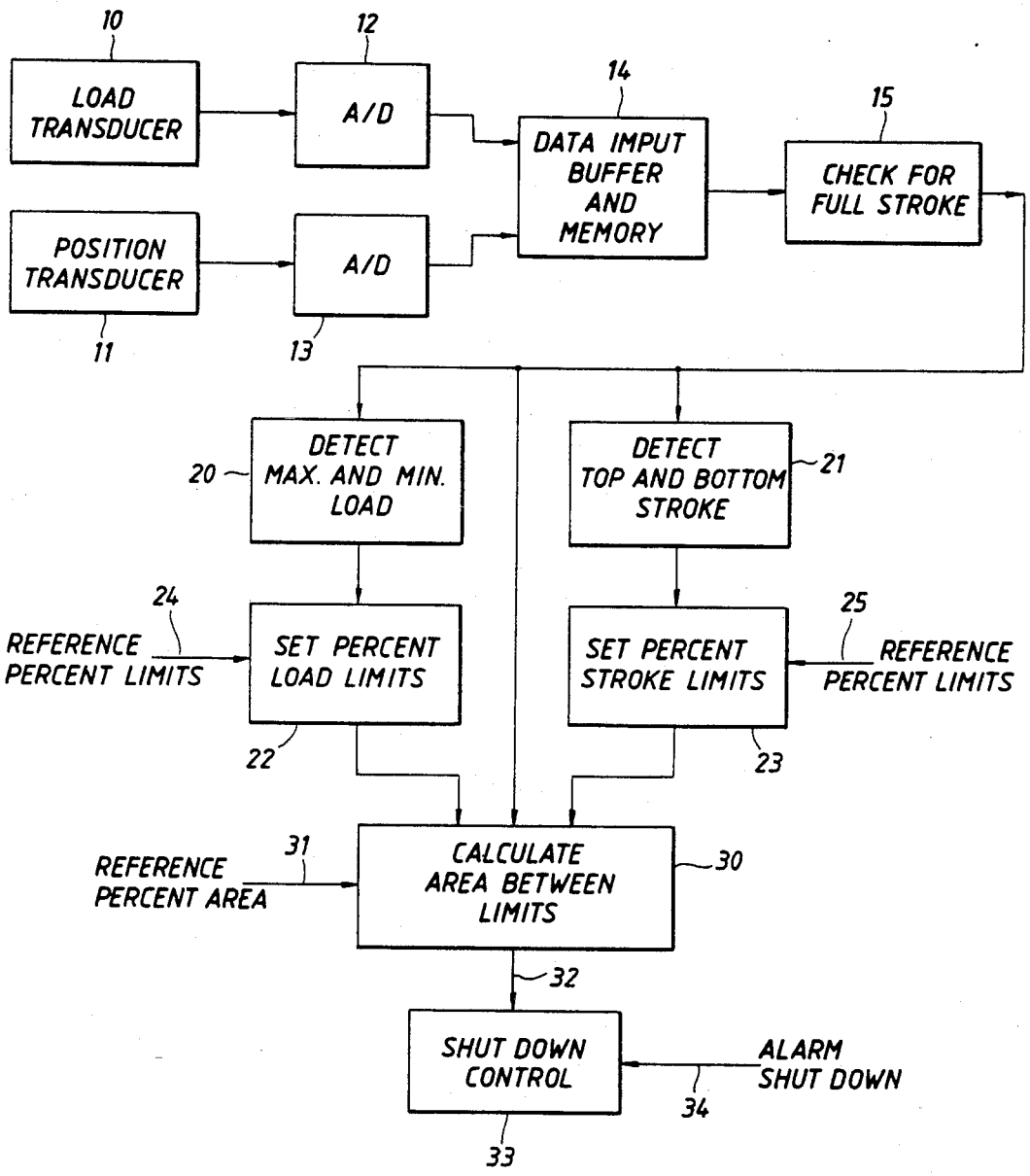
FIG. 2 is a block diagram of the logic used for computing pump-off in the present invention.

The present invention is designed to control the operation of a beam pumping unit used for lifting reservoir fluids from oil wells. In this type of pumping unit an electric motor is used to actuate the walking beam which, in turn, reciprocates the rod string. The rod string, in turn, operates the pump unit located at the bottom of the well. The present invention utilizes a load cell mounted either on the walking beam or in the rod string to measure the actual load on the rod string during a complete stroke of the pumping unit. In addition, a transducer is used to measure the rod position so that the load measurements can correlated with actual rod position. In place of the position transducer it is also possible to utilize the closing of a switch to detect a particular position of the rod. From this detected position, one can determine the approximate position of the rod for each load measurement by a simulation of rod position based on the pumping unit geometry, assumed slip of the drive motor and the top of the stroke. The top of the stroke is determined from the switch closure as described below.

Referring now to FIG. 1, there is shown in the solid line a typical pump card during full pump normal operating conditions. Full pump conditions are defined as those conditions wherein the downhole pump completely fills with fluid during the upstroke of the pump so that upon the next downstroke, the plunger contacts the fluid and the associated travelling valve opens immediately upon the start of the downstroke. Thus, the rod string is partly supported by the fluid in the pump barrel on the downstroke. A pump-off condition is shown by the dotted line in FIG. 1 and in this case, the pump barrel is not completely filled with fluid and the travelling valve does not open until the plunger contacts the fluid. Under these conditions, the rod string is not partially supported by fluid in the pump and the measured load is the combination of the weight of the rod string plus the weight of the fluid in the production tubing above the plunger. Under some conditions, the pump-off curve near the top of the stroke of the pump substantially coincides on the downstroke with the curve on the upstroke.

As shown in FIG. 1, the bottom of the stroke is indicated at BOS while the top of the stroke is denoted TOS. Also, the Min and the Max load are shown. Positioned within the pump card are two position lines denoted as PL 1 and PL 2 and two load lines LL 1 and LL 2. These position and load lines define an area that is used for determining pump-off. In particular, the area of the pump card within the designated area during a full pump condition is measured and when the area falls below a certain percentage the well is designated as pumped-off and the pumping unit is shut down.

While the position lines and load lines are shown in the curve, it should be remembered that these are indicated as a percentage of the full stroke of the pump and a percentage of the difference between the minimum and maximum load. In particular, the limits are set by determining the full stroke of the pump in digital numbers and then setting the position lines as a percentage of these numbers. For example, PL 1 may be the 85% position while PL 2 is set at the 75% position. Similarly, the load lines 1 and 2 are set as a percentage of the difference between the minimum and maximum load. Since the position and load lines are set as percentages the area will be calculated as the percentage squared and the limit for pump-off will also be set as a percentage squared area.

From the above, it can be seen that if the well has a high fluid level it would result in a pump card having a reduced area, a higher minimum load and a lower maximum load. Since the load lines are set as a percentage of the difference between the maximum and minimum loads, the load lines will remain in approximately the same relative position as shown in FIG. 1. In contrast, in those prior art systems where load lines were set in engineering units, they would remain in a fixed position on the scale shown in FIG. 1. Likewise, the area defined by the position and load boundaries would be measured at engineering units and when compared with a reduced area of the pump card the controller would indicate a pumped-off condition when the well actually started with a high fluid level. In contrast, in the present invention, since the load lines are set as a percentage and the area is calculated as percentage squared with the pump-off condition being similarly set as a percentage squared area, the controller will be self-compensating for high fluid levels.

Referring now to FIG. 2, there is shown in block diagram form the logic used for determining a pumped-off condition in a well using the present invention. As shown, a load transducer 10 is connected to an analog-to-digital converting unit 12 while position transducer 11 is connected to a similar analog-to-digital conversion unit 13. The load transducer is an analog device and preferably a strain gauge type load transducer that may be mounted either on the beam of the pumping unit or a load cell mounted directly in the rod string of the pumping unit. When a beam mounted load cell is utilized, it is desirable to use the compensating and correcting circuit shown in FIG. 3 and described in detail below. A load cell mounted directly in the rod string is self-compensating for both temperature changes and beam position and no correction is normally necessary. The position transducer is preferably a potentiometer type of transducer that supplies an analog signal which is directly related to the position of the rod string. Normally, this type of transducer will supply a signal that varies between 1 to 3 volts for the complete stroke of the pumping unit. Instead of a potentiometer transducer, it is possible to utilize the closure of a switch that is actuated by movement of the pumping unit, for example, rotation of the crank arm. The switch provides a reference signal that is related to a particular position of the rod string. When the closing of a switch is used for determining rod position, an additional circuit will be required for generating rod position signals. For example, a microprocessor could be programmed to produce a series of digital position signals with each signal corresponding to the position of the rod string at the time the rod load was measured. The digital output from the A to D converters 12 and 13 are supplied to a data input buffer and memory circuit 14. This circuit collects a complete stroke of both the position and load data plus extra data points. The number of data pairs collected and stored in the buffer unit will depend upon the sampling frequency of the A to D unit and the time duration of each stroke of the pump. The circuit 15 checks to be sure that a complete stroke of the data is stored in the unit before the data is transmitted to the remainder of the circuit. In the present invention, once a complete stroke of data is collected, it is transmitted to the load and stroke detecting circuits 20 and 21. The circuits 20 and 21 detect the maximum and minimum load signals in the complete stroke of data as well as the top and the bottom of the stroke.

The maximum and minimum load data are transmitted to a percentage setting circuit 22 where the load limits are set as a percentage of the difference between maximum and minimum loads. The desired percentage limits are supplied as reference signals 24 that are inputs to the circuit 22. The circuit 22 computes the desired percentages of the difference between the maximum and minimum load measurements. In a similar manner, the circuit 21 detects the top and bottom of the stroke while the circuit 23 sets the percentage limits of the stroke used in calculating the area. The percentage limits are set as percentages of the difference between the maximum and minimum stroke measurements. The percentage limits are set in response to an input reference signals 27. The load limits LL1 and LL2 and stroke limits PL1 and PL2 define a box as shown in FIG. 1. Pump-off is detected by measuring the area of the pump card that falls within the box. Pump-off is detected when the measured area of the pump card is less than a set percentage of the total area of the box. This percentage is set as an input 31 to the circuit 30. All of the areas are determined by integrating two percentage measurements and thus expressed as percent squared. The foregoing calculations are possible with the present invention since the area is calculated as a percentage squared and thus, even in the case of a high fluid level, the actual percentage squared area for the full pump card will be substantially the same as when the fluid level drops to a more normal conditions. Thus, the pump-off limit can be set as a percentage reduction of this area that occurs as the well pumps off. When the circuit 30 determines that the area of the pump card within the box has been reduced to the reference area, a pump-off signal 32 is transmitted to the shutdown control 33. The shutdown control 33 interrupts the power to the motor driving the pumping unit. The shutdown control also receives alarm signals 34 which will shut down the unit upon the occurrence of various abnormal conditions as described below.

While the above description has referred to the various blocks as comprising individual circuits, obviously the circuits 15–33 can all be combined in a single microprocessor unit that is programmed to carry out the desired functions. The programming can be permanent in the form of an E-prom that is programmed to control the microprocessor. This would allow change cf the program used for calculating the maximum and minimum loads, top and bottom of stroke, and other calculations of the invention. In a similar manner, the various reference limits could be set as digital entries to the microprocessor unit. All of these features are within the skill of those working in the pump-off controller art. In particular, commercially available remote transmitting units such as a Model 6008 SX manufactured by Automation Electronics Inc. of Casper, Wyo. incorporates all of the circuits shown in FIGS. 2, 3 and 4 in a single unit. This unit can be programmed by use of an E-prom to carry out all of the features of the present invention.

Figure 3:
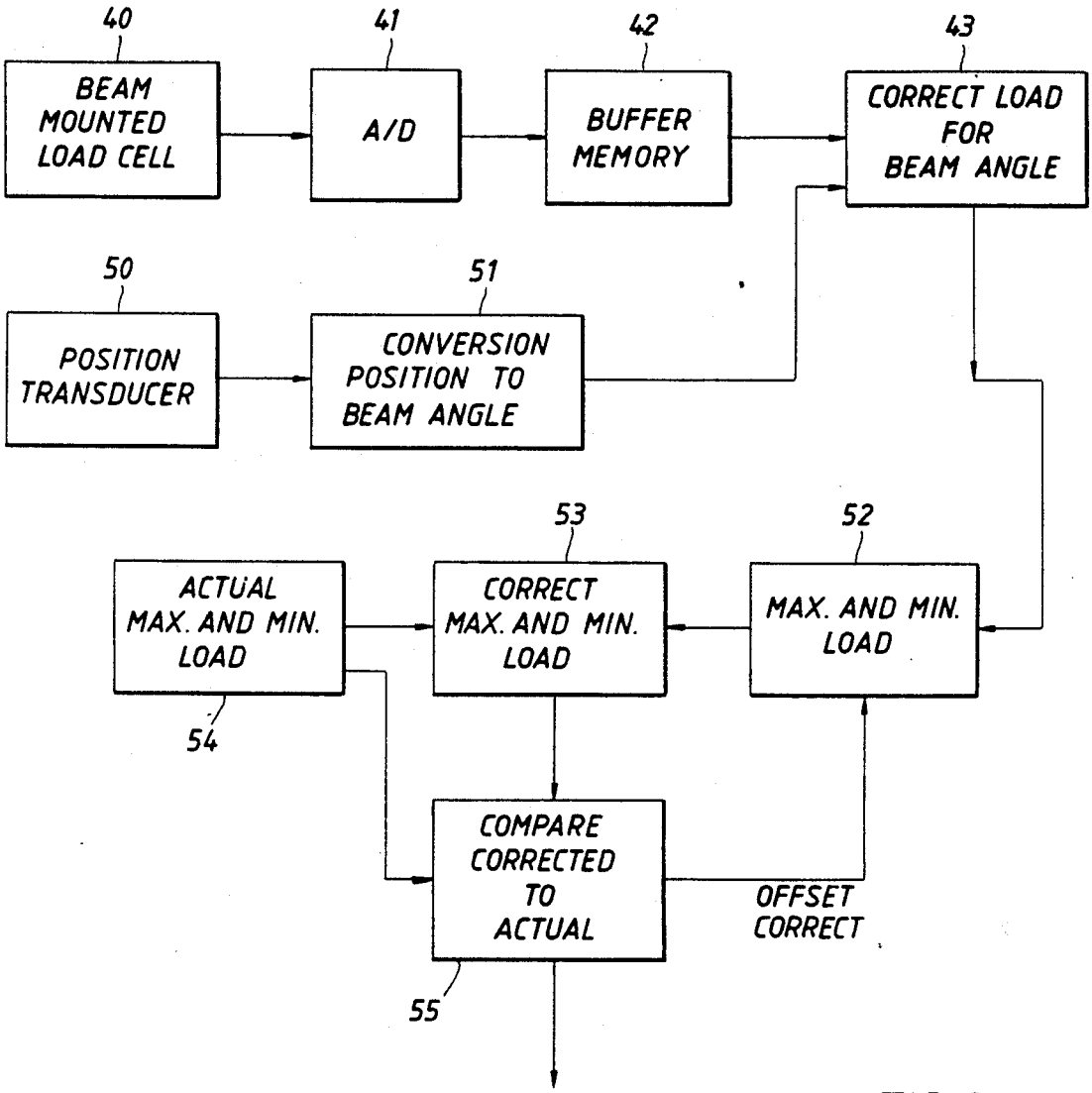
FIG. 3 is a block diagram of the logic used for correcting a beam mounted load cell for both temperature and beam angle.

Referring now to FIG. 3, there is shown the logic required for programming the microprocessor to correct a beam mounted load cell for the angle of the beam. In utilizing the logic shown in FIG. 3, one must first know the geometry of the pumping unit so that the angle of the beam can be related to the position of the polish rod. In addition, the information relating beam angle to polish rod position must be programmed into the microprocessor unit of the pump-off controller. With this information, the output of the beam mounted load cell can then be corrected for the angle of the beam so that the beam mounted load cell measurements relate to the actual position of the polish rod.

In addition to the above required data, one must also know the true load on the rod string versus rod position during normal operation of the pumping unit. This can be accomplished by using a calibrated load cell positioned in the rod string and either the pump-off controller microprocessor or a separate analysis computer or portable diagnostic system. Once the actual load on the rod string is measured no further measurement will be required until some item in the system is changed or replaced. At this time it will be necessary to recalibrate the beam mounted load cell. With the above information, one can determine the calibration for the beam mounted load cell at 2 points in the stroke of the pump unit. The two points to consider are the minimum and maximum measured loads. With the above information one can then compute the offset or correction for the beam mounted load cell from the following formulas:

| | |
|---|---|
| CL (max) = | "Calibration" maximum load value from actual measurement. |
| CL (min) = | "Calibration" minimum load value from actual measurement. |
| R (max) = | Maximum load value from beam mounted load cell. |
| R (min) = | Minimum load value from beam mounted load cell. |
| C (Max) = | Beam angle correction factor at position where R (Max) occurs. |
| C (Min) = | Beam angle correction factor at position where (R (Min) occurs. |
| CR (Max) = | R (Max) corrected for beam angle. |
| CR (Min) = | R (Min) corrected for beam angle. |
| CR (Max) = | f [R (Max), C (max)] |
| CR (Min) = | f [R (Min), C (Min)] |
| Gain = | $\frac{[CL(Max) - CL(Min)]}{[CR(Max) - CR(Min)]}$ |
| Offset = | CL (Max) − [Gain*CR (Max)] |

The above equations can easily be solved by the logic shown in FIG. 3. In FIG. 3, the signal of beam mounted load cell 40 is supplied to A to D converter 41 which, in turn, supplies the data to a buffer memory circuit 42. The memory circuit 42 accumulates the data for a complete stroke of the pumping unit and then supplies the complete stroke data to a microprocessor unit 43 which corrects the measured load for the beam angle. The corrected load data is then supplied to a circuit 52 which determines the maximum and minimum load which is then supplied to a circuit 53 which corrects the maximum and minimum load depending upon the actual minimum and maximum load measurement as received from the circuit 54. The signal from the corrected maximum and minimum load is supplied to a comparing circuit 55 which compares the corrected maximum and minimum signal with the actual maximum and minimum signals and supplies the offset signal to the maximum and minimum load circuit 52 in order to correct the signal. This circuit can be part of the system of FIG. 2 with the microprocessor being programmed to carry out the computations.

In FIG. 4 there is shown a simple circuit for setting various alarms for shutting down the pumping unit. The comparator 60 is supplied with both the corrected maximum load on the upstroke and the corrected minimum load on the downstroke. The comparator compares these measurements with preset units for the shutting down of the pumping unit upon the occurrence of either a high maximum or a low minimum load. These occurrences indicate malfunction of rod strings, such as rod parts or faulty pump units. For example, the pump could be sticking and the rod string failing to fall on the downstroke which would reduce the minimum load on the downstroke to substantially zero and necessitate an immediate shutdown of the pumping unit. Similarly, an excessive load on the upstroke would indicate a sticking pump and also would necessitate shutting down the unit. In addition to the above alarms, it is also possible to program the pump-off controller to compare the measured area to a preset area since, in order to detect rod parts, if the rod string breaks the pumping unit will no longer be doing any useful work and the area of the dynagraph card will be reduced to substantially zero. This can easily be detected by properly programming the pump-off unit.

The time between the production of a signal that indicates a predetermined position in each stroke and the top of the stroke can be determined by the following method. The method uses the following data as operator inputs for computing the actual time between the production of the position signal and the top of the stroke.

BPP The base time in seconds for a single stroke of the pump. This can be entered by the operator from the strokes per minute of the unit.

BTS The base time elapsed between the production of a position signal and the top of the stroke in seconds. This is set by the operator by monitoring the operation of the pumping unit.

BSS The number of data samples per stroke. This is the product of BPP times the number of samples per second.

NSC The number of load data samples taken with total exceeding the number corresponding to a single stroke of the pumping unit.

APP Time in seconds between consecutive position signals as determined from collected data.

ATS Actual calculated time between position signal and top of stroke.

The BPP input is obtained from the pumping unit specification and set by the operator and BSS can be calculated from BPP and the specifications of the pump-off control. The quantities NSC and BTS are calculated by monitoring the pumping unit. The actual time to the top of the stroke is calculated using the expression:

$$ATS = BTS \times APP / BPP$$

The quantity NSC is set at some value greater than the actual stroke, for example 1.05, while ANP is the number of data points collected during an actual stroke. Any extra data points are used as the beginning of the next stroke. The position value associated with the load value at the top of the stroke is the actual stroke in inches while the position value for the load at the bottom of the stroke is 0 inches. The position values associated with each of the remaining load values are determined by reference to the position table loaded in the system by the operator. These values will depend on the geometry of the pumping unit and its direction of rotation.

The system can adjust for temperature drift of a beam mounted load cell of the type described in U.S. Pat. No. 3,817,094, using the following method.

| Definitions | |
|---|---|
| CL(Max) | The calibrated maximum load entered by the operator. |
| L(Max) | The maximum measured upstroke load. |
| Offset (old) | Value of offset currently being used. |
| Offset (new) | New value of offset calculated by the method of this invention. |
| Gain | Gain value of control unit. |
| Deadband | Value of the dead band, set by operator in percent. Range 1% to 3%. |
| Offset change | Amount offset can be changed per stroke, set by operator. Range 0.1% to 0.2%. |
| Cumulative Change | The cumulative change in offset in current pump cycle. |
| Max Change | Maximum amount offset can be changed (up or down) in one pump cycle, set in percent by operator. |

Using the above definitions and the data collected for one pump stroke the microprocessor of the pump-off controller can be programmed to compute the offset of the beam mounted load cell using the following expressions:

If L(Max)−CL(Max) is greater than Deadband×CL(Max)/100 then compute new offset.

$$\text{Offset (new)} = \text{Offset (old)} - \left[\text{offset (old)} \times \frac{\text{Offset change}}{100}\right]$$

If the cumulative change plus offset change does not exceed Max change then offset change is algebraically added to offset (old) to provide offset (new). The offset (new) is used to adjust the data from the beam mounted load cell for the next pump stroke. The adjustment process is continued until the cumulative change exceeds max change of the pumping unit and is shut down by the pump-off controller. When the pumping unit is restarted the adjustment process is reinitiated. The above described process will adjust the offset of the beam mounted load all to compensate for both temperature increases and decreases.

What is claimed is:

1. A method for monitoring a rod pumped well to detect when the well pumps-off, said method utilizing the measured rod load and measured position for at least one complete stroke of the pump, said method comprising:

setting a maximum load limit that is a predetermined percentage of the difference between the maximum measured rod load and the minimum measured rod load;

setting a minimum load limit that is a predetermined percentage of the difference between the maximum measured rod load and the minimum measured rod load;

setting a first position limit that is a predetermined percentage of the difference between the measured top and bottom positions of the rod;

setting a second position limit that is a predetermined percentage of the difference between the measured top and bottom positions of the rod;

integrating the load versus displacement measurements for all values of the load and displacement measurements that fall within the set maximum and minimum load limits and the first and second position limits; and comparing the result of the integration with a preset value to determine when the well pumps off.

2. The method of claim 1 wherein the load limits are set between zero and one hundred percent of the difference between the maximum and minimum measured rod loads and the position limits are set between zero and one hundred percent of the difference between the top and bottom positions of the rod.

3. The method of claim 1 wherein the rod position is measured continuously by a transducer.

4. The method of claim 1 wherein the rod position is simulated by using a signal produced once for each stroke of the pump at a predetermined position for each stroke of the rod and the actual length of the overall stroke of the rod.

5. The method of claim 4 wherein an elapsed time (BTS) between the production of the signal and the top of the stroke is determined and the time between consecutive signals is measured; the measured time being used to correct the elapsed time (BTS) between the production of the signal and the top of the rod stroke.

6. The method of claim 5 where the actual time ATS between the production of the signal and the top of the rod stroke is calculated from the following equation $$ATS = \frac{BTS - APP}{BPP}$$

wherein BPP is the base time for a single stroke of the pump and APP is the time between the production of consecutive position signals.

7. A method for monitoring a rod pumped well wherein an uphole unit reciprocates a rod string to reciprocate a downhole pump, said method detecting when the well pumps-off, utilizing the continuous measurement of the load on the rod string and the closing of a switch means once each stroke to indicate rod string position, said method comprising:

determining position of the rod string when the pumping unit reaches the top of the pump stroke;

simulating the position of the rod using the known geometry of the pumping unit and the top of the stroke position and converting the simulated position into a plurality of position data points;

producing a plurality of load data points related to the measured load on the rod;

assigning for a complete stroke of the pump a position data point to the load data point that corresponds to each position data point;

setting a minimum load limit that is a predetermined percentage of the difference between the maximum measured rod load and the minimum measured rod load;

setting first and second position limits that are predetermined percentages of the difference between the simulated top and bottom position of said rod;

integrating the difference between the minimum load limit and the measured load over the interval between said first and second position limits; and producing a control signal for shutting down the pumping of the well when the integrated area is less than a preset value.

8. A method for monitoring a rod pumped well wherein an uphole unit reciprocates a rod string to reciprocate a downhole pump, said method detecting when the well pumps-off, utilizing the measured load on the rod string and measured position of the rod string and integrating the measured load and position over some portion of the stroke of the downhole pump to detect when the well pumps-off, the improvement comprising:

setting the limits of the integration as predetermined percentages of the difference between measured maximum and minimum measured rod load and the difference between the measured rod position at the top of the stroke and measured rod position at the bottom of the stroke.

* * * * *